US005097678A

United States Patent [19]

Aubuchon

[11] Patent Number: 5,097,678

[45] Date of Patent: Mar. 24, 1992

[54] VENTILATING PROTECTIVE COVER FOR TOP-DISCHARGE AIR CONDITIONERS

[76] Inventor: Steven L. Aubuchon, 4029 St. Barbara, St. Ann, Mo. 63074

[21] Appl. No.: 615,299

[22] Filed: Nov. 19, 1990

[51] Int. Cl.[5] ..... F25B 39/04; B65D 65/02

[52] U.S. Cl. ..... 62/506; 62/507; 62/DIG. 16; 150/165; 150/154

[58] Field of Search ..... 62/506, 507, DIG. 16; 237/79; 150/165, 154; 98/116

[56] References Cited

U.S. PATENT DOCUMENTS

| | | | |
|---|---|---|---|
| 2,705,990 | 4/1955 | Miller | 150/165 |
| 2,711,769 | 6/1955 | Katcher et al. | 150/165 |
| 3,320,996 | 5/1967 | Singer | 150/165 |
| 4,055,113 | 10/1977 | Monroe | 98/116 X |
| 4,202,389 | 5/1980 | Ewald | 150/165 |
| 4,228,663 | 10/1980 | Picarello | 62/507 |
| 4,308,905 | 1/1982 | Gallagher | 150/165 |
| 4,437,868 | 3/1984 | Kuhlman | 98/116 X |
| 4,498,912 | 2/1985 | Wagner | 62/DIG. 16 X |
| 4,625,784 | 12/1986 | Boroson | 150/165 |
| 4,723,419 | 2/1988 | Kessler et al. | 62/507 |
| 4,745,769 | 5/1988 | Wooden, Jr. | 150/154 X |
| 4,815,530 | 3/1989 | Scott | 62/507 X |
| 4,870,832 | 10/1989 | Crawley | 165/47 X |

*Primary Examiner*—Henry A. Bennet
*Assistant Examiner*—Christopher B. Kilmer
*Attorney, Agent, or Firm*—Jerome A. Gross

[57] ABSTRACT

For protection of the condenser unit of a split system residential air conditioner of the top-discharge type, a ventilating cover has an impervious top panel and substantially impervious skirt, while the lower edge of the skirt may substantially coincide extending downward therefrom with the downward extent of the motor and fan inside the condenser unit, since the lower part of the unit remains uncovered and corrosion-avoiding ventilation is provided.

4 Claims, 1 Drawing Sheet

VENTILATING PROTECTIVE COVER FOR TOP-DISCHARGE AIR CONDITIONERS

BACKGROUND OF THE INVENTION

1. Field of the Invention

This invention relates to protective covers for exterior condenser units of the top-discharge type of split system air conditioners.

2. Description of Related Art

Applicant is aware of no prior patent to protect such units; prior patents known to Applicant, such as U.S. Pat. No. 4,308,905 to Gallagher, U.S. Pat. No. 4,625,784 to Boroson, and U.S. Pat. No. 4,202,389 to Ewald, focus on coverings for room air conditioners of the window or through-the-wall type. A primary purpose of such covers, which totally enclose the exterior portions of such units, is to prevent heat loss through the air conditioner unit from a room when the air conditioner is not in use. U.S. Pat. No. 2,705,990 to Miller teaches, for use on a room air conditioner, a protective cover so vented as to allow exhausting of room air and intake of outdoor air.

Malfunctioning of the motors, necessitating their replacement, is a significant problem for the top discharge condenser units of split system air conditioners, as the open-grill construction of these units exposes their motors to debris such as leaf particles and dirt. However, if the unit is enclosed by a cover, humidity develops within the enclosure, corroding the structure and operative parts of the unit.

Prior attempts to enclose the exterior condenser unit of a split system air conditioner, such as by covering with flexible plastic or cloth, have resulted in the development of humidity within the unit, subsequently causing corrosion of the structure and operating components.

SUMMARY OF THE INVENTION

The exterior compressor unit of a split system air conditioner for residential use involves operating principles different from those of a room unit. The recent trend in split system air conditioner design is to discharge air through an outlet grill at the top of the unit rather than the sides of the unit. Top discharge units include a partially circumferential heat exchange coil protected from impact on its outer side by an air inlet grill, which subsantially surrounds sealed components located in the base of the unit. The fan motor of such a unit is normally bolted centrally onto the undersurface of the top outlet. Its fan is mounted on a perpendicularly downward-extending motor shaft, and operates on a horizontal plane below the motor, with its blades cupped upward. When the air conditioner is not operating, dirt, leaf particles, and like debris may collect on the cupped fan blades, become sodden by moisture, cover the extending shaft, and communicate corrosion upward along it, through openings such as ventilating opening in the motor casing and into the motor.

A top cover over the air outlet grill is insufficient to prevent accumulation of windborne debris on the fan blades; completely enclosing the condenser unit results in formation of humidity, and concomitant corrosion of the structural and operative parts of the unit. Both problems are solved, however, by a relatively simple design for a skirted cover which shields the upper part of the unit to prevent accumulation of debris on the fan blades as shown in FIG. 1, while leaving the lower part of the unit open for ventilation, thereby avoiding corrosion. Though debris driven through that portion of the air inlet grill below the protective cover may accumulate in the bottom of the unit, experience shows this to be harmless to the sealed parts located therein.

Use of the ventilating protective cover appears to reduce the frequency of service calls for motor related problems by two-thirds.

DESCRIPTION OF THE PREFERRED EMBODIMENT

Figure 1:
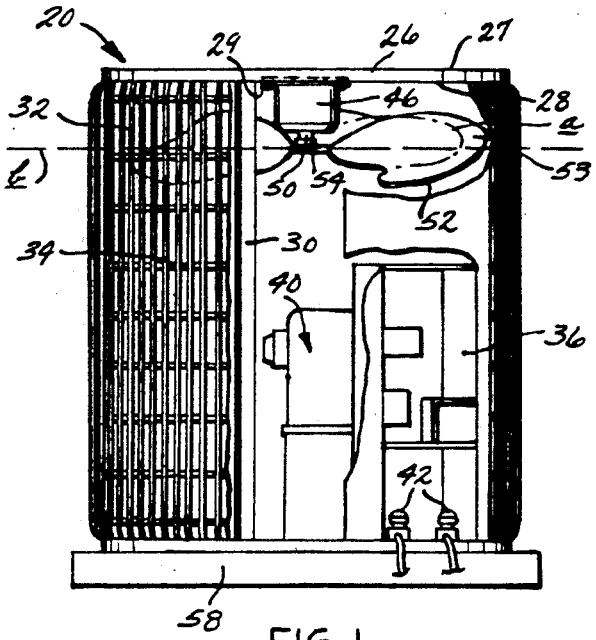
FIG. 1 is an elevational view, partly broken away, of the exterior condenser unit of a split system air conditioner whose air inlet grill and finned coil are partially broken away to show its operative components, fan motor and blades, with accumulation of debris on the fan blades illustrated in phantom lines.

A conventional top discharge exterior condenser unit 20 of a split system air conditioner is illustrated in FIG. 1, with potentially damaging debris shown accumulated on the upper surfaces 53 of fan blades therewithin, such debris extending inward toward a fan hub 50. The condenser unit 20 comprises a top outlet grill 26, a nearly circumferential vertical finned heat exchanger coil 30 sheathed by a protective air inlet grill 32, conventional sealed operating components, generally designated 40, substantially centered at the base of the condenser 20 within the heat exchanger coil 30, and, in a short arcuate section, a control box 36 which houses a conventional refrigerant valve 42, and an electrical connection, not shown, the control box being closable by a vertically slidable surface access panel 38 having valve and connection accommodating slots 39.

As FIG. 1 illustrates, a compressor fan motor 46 is centrally mounted on the undersurface 28 of a central plate 29 of the top outlet grill 26. The motor shaft 50 extends downward; a hub 54 attached thereto bears the horizontal fan blades 52, 52', which are cupped upward for efficiently exhausting air through the top outlet grill 26.

Figure 2:
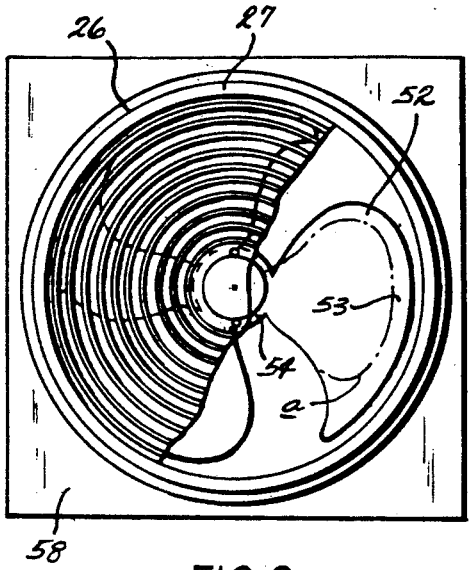
FIG. 2 is a top view of the unit of FIG. 1.

When the unit 20 is in operation, air flows unrestrictedly through the open top outlet grill 26 and the air inlet grill 32. When the unit is not in operation, however, the open construction of the grills 26, 32 allows windborne and falling debris, which may become sodden by moisture, to accumulate, as FIGS. 1 and 2 illustrate, on the curvingly cupped upper surfaces 53, 53' of the fan blades 52, 52' and about the shaft 50, where small portions of debris and acids may enter the fan motor 46 along the shaft 50 or through ventilating openings in the motor casing 48.

The function of the ventilating protective cover 10 of the present invention is to shield the fan motor 46, to prevent debris from entering the condenser unit 20 through both the top outlet grill 26 and the air inlet grill 32. The ventilating cover 10, shown secured onto a compressor unit in FIGS. 3 and 4, may be constructed from a durable, weatherproof, substantially impervious sheet material, preferably a heavy grade of flexible vinyl or vinyl impregnated cloth which may be pigmented as desired.

Figure 3:
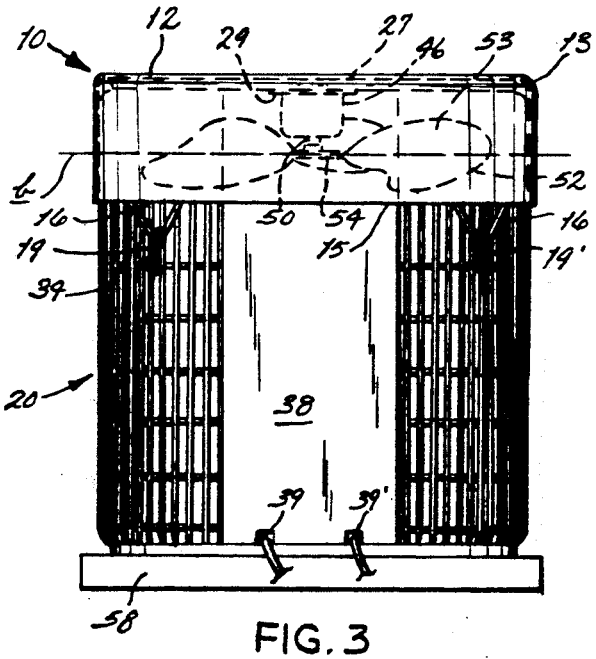
FIG. 3 is an elevational view of the protective cover of the present invention, secured onto the compressor unit such as that of FIG. 1.
Figure 4:
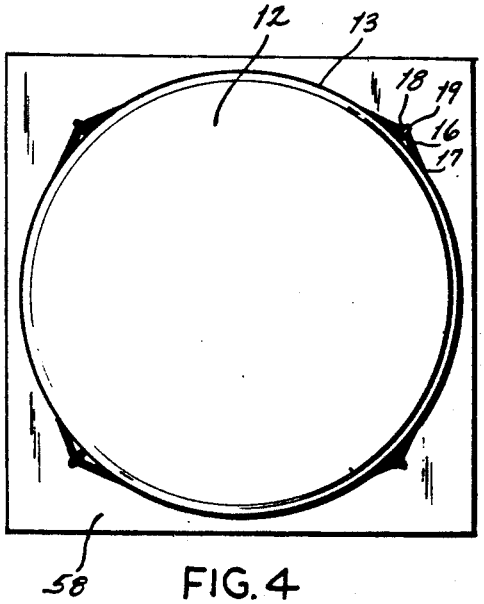
FIG. 4 is a top view of the cover in FIG. 3.

The cover 10 as illustrating FIG. 3 comprises a top cover panel 12 which, laying flat upon and extending to but not beyond the outlet grill 26, shields the horizontal outer surface 27 of the outlet grill 26. A skirt portion 14 shown in FIG. 3 is attached about the outer edge 13 of said top cover panel 12 and extends perpendicularly downward therefrom. Said skirt portion 14 fits snugly about that upper portion of the air inlet grill 32 which houses the fan assembly 44, and terminates below the plane of rotation b of said fan blades 52.

Preferably the cover 10 may be secured to the unit 20 by four flexible elastic straps 16, 16', two of which are shown in FIG. 3, attached by each of their ends 17, 17' spacedly above the bottom 15 of the skirt 14. An "S" hook may be placed at the middle of each strap 16, 16', and pulled downward to be secured onto a horizontal member 34 of the air inlet grill 32, providing the strap 16, 16' with a "V" shape. Such means of attachment exerts substantially uniform downward tension on said skirt 14, securing said cover 10 onto said compressor unit 20.

The impervious ventilating cover 10 of the present invention, snugly fitted atop the outlet grill 26 and about the air inlet grill 32, blocks the entry of dust, leaf particles, and the like into that upper portion of the compressor unit 20 which houses the fan assembly 44. The length of the skirt 14, extending downward only to below the plane of rotation b of the fan blades 52, allows sufficient ventilation within the condenser unit 20 to avoid condensation and the resulting corrosion damage that occurs when the unit 20 is fully enclosed by a cover. While windborne debris may enter the uncovered lower portion 24 of the unit, slightly elevated on a concrete pad 58, and there accumulate, an accumulation of debris on the fan blades 52 and about the hub, with subsequent entry into and damage to the motor 46, does not occur.

The cover is designed for use only during those periods when the air conditioner system is not in use; the cover must be removed when the air conditioner unit is operated. Motor-damaging debris is able to accumulate only when the fan blades are stationary; when the unit is operating, rotation of the fan blades centrifugally expels such debris outward and away from the motor shaft and/or ventilating openings in the motor casing.

While in the preferred embodiment shown in FIG. 3, the skirt extends just below the plane of rotation of the fan blades, it may be preferred to have a skirt extend downward from the top outlet grill as far as one-half the height of the air inlet grill, leaving the lower half of the unit open for ventilation.

This length accommodates various units, which may have shafts of varying length or variations in the plane of rotation of the fan blades.

While the preferred embodiment contemplates a substantially circumferential top outlet grill and condenser unit, the operative principle of the present invention applies also to top outlet units of other configurations, such as square or rectangular units.

As various modifications may be made in the constructions herein described and illustrated without departing from the scope of the invention, it is intended that all matter contained in the foregoing description or shown in the accompanying drawings shall be taken as illustrative rather than limiting.

I claim:

1. For use with an air conditioner exterior condenser unit of the top outlet type having a substantially circumferential air inlet grill inwardly adjacent to which is a finned coil, in which a fan-driving motor is centrally secured to a top outlet grill, and in which fan blades have a plane of rotation beneath the motor, a protective ventilating cover comprising an impermeable top cover panel, and an impermeable skirt extending downward therefrom to a lower skirt edge at least coincident with such plane of blade rotation within said inlet grill, leaving a lower portion of said circumferential inlet grill uncovered, whereby to protect such fan-driving motor and fan blades from damage resulting from accumulation of debris and precipitation, and yet permit ventilation thereabout.

2. A protective cover as defined in claim 1, further comprising means to secure said skirt of said cover to such air inlet grill.

3. A protective cover as defined in claim 2, wherein said means to secure further comprises a plurality of straps terminating in means to attach said straps to such air inlet grill.

4. For use with an air conditioner exterior unit of the top outlet type, the unit having along its outer side an air inlet grill inwardly adjacent to which is a finned coil, in which a fan driving motor and fan are adjacent to a top outlet grill, a protective ventilating cover comprising an impermeable top cover panel, a substantially impermeable skirt extending downward therefrom no more than substantially one-half the height of said air inlet grill, and means to secure said skirt of said cover to such air inlet grill, said means to secure comprising a plurality of straps terminating in means to attach said straps to such air inlet grill, whereby to protect such fan-driving motor from damage resulting from accumulation of debris and precipitation, and to permit ventilation thereabout.

* * * * *